US005652989A

United States Patent [19]

Chiba et al.

[11] Patent Number: 5,652,989

[45] Date of Patent: Aug. 5, 1997

[54] APPARATUS FOR REMOVING AN IMAGE FORMING SUBSTANCE FROM AN IMAGE DEPOSITED RECORDING MEDIUM

[75] Inventors: Eriko Chiba, Kawasaki; Hidenori Tomono, Yokohama; Hiromichi Komai, Yokohama; Toshio Kawakubo, Yokohama, all of Japan

[73] Assignee: Ricoh Company, Ltd., Tokyo, Japan

[21] Appl. No.: 586,278

[22] Filed: Jan. 16, 1996

[30] Foreign Application Priority Data

Jan. 14, 1995 [JP] Japan ..... 7-021150

[51] Int. Cl.[6] ..... B08B 1/02; G03G 21/00

[52] U.S. Cl. ..... 15/3; 15/77; 15/102; 399/349

[58] Field of Search ..... 15/1.51, 102, 3, 15/97.1, 100, 103.5; 355/296, 297, 301; 156/230, 247, 241, 281

[56] References Cited

U.S. PATENT DOCUMENTS

| | | | |
|---|---|---|---|
| 4,129,919 | 12/1978 | Fitch et al. | 15/102 |
| 4,530,595 | 7/1985 | Itaya et al. | 355/296 |
| 5,353,108 | 10/1994 | Tsukamoto | 355/296 |
| 5,400,123 | 3/1995 | Sato et al. | 15/102 |
| 5,474,617 | 12/1995 | Saito et al. | 15/102 |

FOREIGN PATENT DOCUMENTS

| | | |
|---|---|---|
| 297294 | 11/1989 | Japan . |
| 64472 | 2/1992 | Japan . |
| 64473 | 2/1992 | Japan . |
| 333088 | 11/1992 | Japan . |

*Primary Examiner*—Tony G. Soohoo

*Attorney, Agent, or Firm*—Oblon, Spivak, McClelland, Maier & Neustadt, P.C.

[57] ABSTRACT

An apparatus for recycling a recording medium having an image forming substance deposited on both sides of the recording medium. A first image removing unit removes the image forming substance from a first side of the recording medium and a second image removing unit removes the image forming substance from a second side of the recording medium. A driving portion feeds the recording medium sequentially through the first image removing unit and then through the second image removing unit. Each image removing unit includes an image separating material which is constructed of a substance to which the image forming substance tends to adhere to and a backpressing material, which is formed opposite to the image separating material, and which presses the recording medium against the image forming substance. A surface of the backpressing material is formed of a material to which the image forming substance tends not to adhere.

14 Claims, 5 Drawing Sheets

APPARATUS FOR REMOVING AN IMAGE FORMING SUBSTANCE FROM AN IMAGE DEPOSITED RECORDING MEDIUM

BACKGROUND OF THE INVENTION

1. Field of the invention

The present invention relates to an apparatus for removing an image forming substance, such as toner, from a recording medium, such as paper, on which the image forming substance is deposited for thereby recycling the recording medium, and more particularly to an apparatus for effectively removing the image forming substance from both sides of the recording medium.

2. Discussion of the Background Art

With the recent spread of printers and copying machines employing various kinds of image forming processes such as an electrophotographic method, a thermal transfer method or an ink-jet method using a hot-melt ink, a large quantity of paper sheets are being used and consumed. This has caused the problems of environmental disruption of the earth due to deforestation because the paper generally used as the recording medium contains pulp as a raw material. In addition, with the increase of consumption of such paper, the problem of waste treatment has become serious.

A transparent sheet is also used as the recording medium for an overhead projector (OHP). Such a transparent sheet employs as a base material a plastic film such as a polyester film. Most of the raw materials for use in such a plastic film are made of petroleum. It is therefore desirable to make efficient use of resources of such a recording medium with the drain of oil resources taken into consideration. In addition, most plastic films have no biodegradability, so that after these plastic films are discarded, they will float on the ocean as dust. It follows as a consequence that environmental disruptions are induced by the use of a recording medium for an overhead projector.

In order to solve the above problems, used paper or film sheets may be collected and subjected to beating or melting again to recycle such recording mediums. However, energy is not efficiently used in such a recycling method, with the result that the cost of the recycled sheets may be higher as compared with the case where paper and film sheets are made of new raw materials, or the quality of the papers and films obtained by the above-mentioned recycling method is lowered.

Recently there have been proposed a few methods and apparatuses for recycling paper and film sheets on which images are deposited by the electrophotographic process. As one of these methods, as disclosed in Japanese Laid-Open Patent Application (KOKAI) 7-84396, there is proposed a method which includes the steps of impregnating a recording medium having an image forming substance, such as a toner image, deposited thereon with an image removal promoting liquid to weaken the adhesion between the recording medium and the image forming substance deposited on the recording medium by the electrophotographic process; pressurizing or heating the recording medium containing the image forming substance to melt or soften the image forming substance; contacting the image forming substance with an image separating material which is constructed of a substance for making the image forming substance tend to be more easily attached onto the surface of the image separating material in comparison with the recording medium including the liquid, i.e., the image separating material adheres to the image forming substance greater than the image forming substance adheres to the recording medium after treatment by the liquid; and peeling the image forming substance from the recording medium by transferring the image forming substance onto the image separating material. This recycling method has the advantages that images formed on a plain copy paper sheet for general use can also be removed therefrom, and there is no problem in terms of safety and hygiene.

In this reference there is proposed an apparatus having a pair of image separating materials for removing image forming substances deposited on both sides of an image recording medium.

However, in a case the image separating material is incompletely cleaned in this apparatus, there are problems that the pair of the image separating materials cling to each other by the melted or softened image forming substance between them, as the image forming substance becomes sticky when it melts or softens and the image separating material is constructed of a substance for making the image forming substance tend to be more easily attached onto the surface of itself in comparison with the recording medium after treatment by the liquid. In a case of using the pair of the image separating materials, there are the same problems if not using the image removal promoting liquid.

There is proposed another apparatus for recycling both-sided copying paper by the same applicant of the present invention as disclosed in Japanese Laid-Open Patent Application (KOKAI) 7-175381. This apparatus includes a recycling unit that uses the method as disclosed in the Japanese Laid-Open Patent Application (KOKAI) 7-84396 and a reversal unit for putting back the image recording material with the removed image forming substance on one side to the recycling unit through a feedback route. However, in this apparatus there are drawbacks of complicating a structure of the apparatus.

SUMMARY OF THE INVENTION

Accordingly, one object of the present invention is to provide a novel apparatus for removing an image forming substance from both sides of an image deposited recording material without image separating materials clinging to each other and without complicating a structure of the apparatus.

In accordance with the present invention, this object is attained by an apparatus for recycling a recording medium with an image deposited thereon which includes a first image removing unit for removing an image forming substance from one side of the recording medium and a second image removing unit set close to the first image removing unit for removing the image forming substance from the other side of the recording medium. The first and second image removing units each include an image separating material constructed of a substance for making the image forming substance tend to be more easily attached onto the surface thereof in comparison with the recording medium, a backpressing material opposite to the image separating material for pressing the recording medium against the image separating material, and the backpressing material being constructed of a substance to which the image forming substance does not easily cling.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
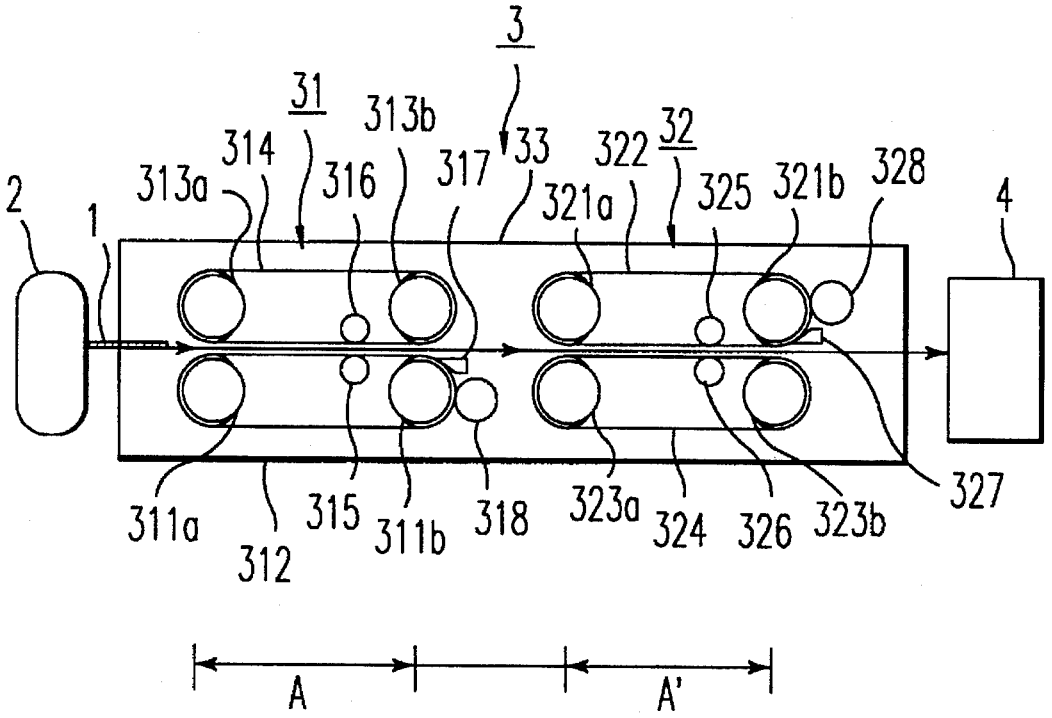
FIG. 1 shows an embodiment of the present invention in which an image removing unit is separated into a first image removing unit and a second image removing unit.

This invention will be described in further detail by way of example with reference to the accompanying drawings in which like reference numerals indicate identical or similar elements throughout the various figures.

Referring first to the embodiment of the present invention shown in FIG. 1, there is shown an apparatus for recycling a recording medium 1 having deposited thereon an image forming substance on both sides of the recording medium 1. The recycling apparatus includes a liquid supplying unit 2 including means for feeding the recording medium 1, an image removing unit 3 including a first image removing unit 31 and a second image removing unit 32, and a finishing unit 4 for ejecting and receiving the recycled recording medium.

The recording medium 1 has at least a portion of a material such as a fibrous surface including at least a paper like layer having fibers like a sheet of paper or a sheet for an overhead projector. As a concrete example, the recording medium 1 may be a plain copy paper for general use or a sheet for an overhead projector for general use, but the recording medium 1 is not limited to these materials. The image forming substance formed stably on the fibrous surface of the recording medium 1 is usually deposited on the recording medium 1 by an electrophotographic process or the like. As a concrete example, the image forming substance may be a kind of toner, but the image forming substance is not limited to such materials.

In the liquid supplying unit 2, the recording medium 1 is impregnated with an image removal promoting liquid to weaken the adhesion between the recording medium 1 and the image forming substance deposited on the recording medium 1, and the liquid impregnated recording medium is then fed to the image removing unit 3.

Figure 2A:
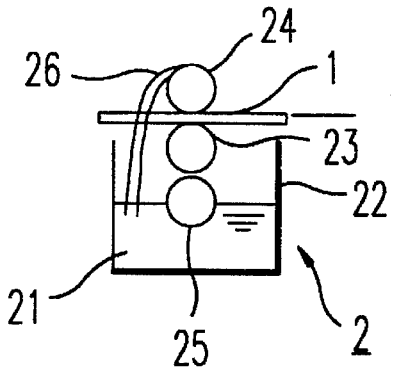
FIGS. 2(*a*) and 2(*b*) show an example of a liquid supplying unit.
Figure 2B:
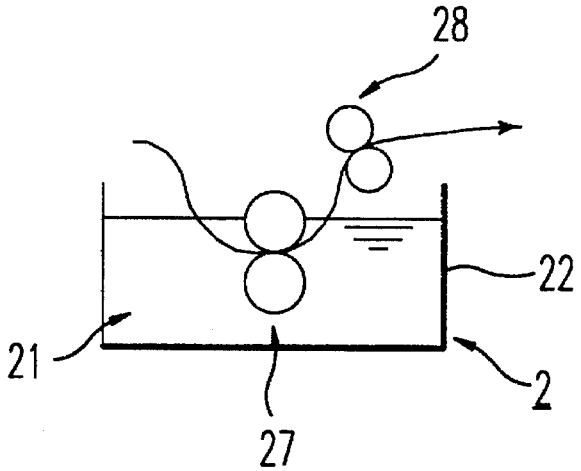

A constructional example of the liquid supplying unit 2 using a system for impregnating the recording medium 1 with the image removal promoting liquid will next be explained with reference to FIG. 2(*a*) and 2(*b*). In FIG. 2(*a*), the unit 2 includes a liquid container 22 storing the image removal promoting liquid 21, a pair of impregnating rollers 23, 24 including a lower impregnating roller 23 and an upper impregnating roller 24, the pair of impregnating rollers 23, 24 being driven by a drive unit (not shown), a liquid drawing up roller 25, a liquid supplying pipe 26 through which the liquid is drawn up by, e.g., a pump (not shown). The liquid container 22 is filled with a predetermined amount of the liquid 21. At least a surface portion of each of the impregnating rollers 23 and 24 is formed by a liquid absorbing material. The impregnating rollers 23 and 24 convey the recording medium 1 while the recording medium 1 is supported by the impregnating rollers 23, 34 therebetween. The liquid drawing up roller 25 is used to supply the liquid 21 to the lower impregnating roller 23 and the liquid supplying pipe 26 is used to supply the liquid 21 to the upper impregnating roller 24.

A liquid absorbing material of the surfaces of the pair of impregnating rollers 23, 24 may be constructed of a material to hold the liquid 21 and supply the liquid 21 to the recording medium 1 such that the transfer recording medium 1 is impregnated with the liquid 21. As a concrete example, the liquid absorbing material may be constructed of a sponge, a felt, etc., but the liquid absorbing material is not limited to these materials. In this example, the recording medium 1 fed from a feed unit is conveyed by the pair of impregnating rollers 23, 24 holding the liquid 21 on surfaces thereof and an interior portion thereof while the recording medium 1 is supported between these impregnating rollers 23, 24. As this time, both upper and lower faces of the recording medium 1 are impregnated with the liquid 21.

Another constructional example of the liquid supplying unit 2 using a system for dipping the recording medium 1 into the liquid 21 will next be described with reference to FIG. 2(*b*). This liquid supplying unit 2 has a pair of feeding rollers 27 formed inside the liquid 21 stored in a container 22, and a pair of wringing rollers 28 formed outside of the container 22. The recording medium 1 fed from a feed unit is driven into the liquid 21 in the container 22, and thereafter excess liquid 21 is wrung out by the pair of wringing roller 28 formed outside of the container 22.

The image removal promoting liquid is preferably at least one kind of liquid selected from the group of a water, an aqueous solution comprising a surface active agent, an aqueous solution comprising a water soluble polymer and an aqueous solution comprising a surface active agent or a water soluble polymer.

Referring now again to FIG. 1, the image removing unit 3 will next be explained in detail.

The image removing unit 3 includes a first image removing unit 31 for removing an image forming substance from one side of the recording medium 1 and a second image removing unit 32 for removing an image forming substance from the other side of the recording medium 1.

The first image removing unit 31 has an image separating belt 312 functioning as an image separating material tensioned between conveying rollers 311*a* and 311*b*, a backup belt 314 functioning as a backup material touching the image separating belt 312 and tensioned between conveying rollers 313*a* and 313*b*, these belts 312 and 314 being driven by drive means (not shown), a pressing roller 315 pressing on an inner side of the image separating belt 312, a heating roller 316 having a heating lamp therein pressing on an inner side of the backup belt 314 against the pressing roller 315, a separating claw 317 touching onto the image separating belt 312, and a cleaning roller 318 pressing against a surface of the image separating belt 312.

The image separating belt 312 is constructed of a substance for making the image forming substance tend to be easily attached onto the surface of the image separating belt 312 in comparison with the recording medium 1. As a concrete example, the image separating belt 312 may be made of any of polyethylene terephthalate having dispersed titanium oxide, polyethylene terephthalate or polyamid, or may be constructed by these substances on a surface of some basic belt, but the image separating belt 312 is not limited to these materials. The backup belt 314 is constructed of a substance to which the image forming substance does not easily cling. As a concrete example, the backup belt 314 may be made of silicone rubber, or may be constructed by a fluorine surface active agent or silicone resins coated on a surface of a basic belt of polyimide, aluminum, nickel, but the backup belt 314 is not limited to these materials.

The image deposited recording material 1 impregnated with the liquid fed from the liquid supplying unit 2 is fed between the image separating belt 312 and the backup belt 314 and is moved toward the second image removing unit 32 between these belts 312 and 314 by friction of these belts. The recording material 1 is heated meanwhile by the backup belt 314 heated by the heating roller 316, and the recording medium 1 comes in press contact with the pressing roller 315 and the heating roller 316. As a result of this operation, the image forming substance formed on the recording medium 1 is peeled off the recording medium 1 and the image forming substance is transferred onto the image separating belt 312. This embodiment shows roller 316 including a heating lamp and functioning as a heating roller, however, the heating lamp may also instead be placed inside of any of rollers 319, **313*b* or 311*b***.

A length A between conveying roller **313*a* and 313*b* and a length A' between conveying roller 321*a* and 321*b* of a second image removing unit 32, described in more detail below, is longer than a length of the recording medium 1** in a feeding direction.

The separating claw 317 operates to separate the recording medium 1 from the image separating belt 312. Further, the cleaning roller 318 cleans the surface of the image separating belt 312 to re-separate the image forming substance transferred onto the image separating belt 312 from the recording medium 1. The cleaning roller 318 is, for example, a brush roller constructed by SUS loop brush.

The recording medium 1 thus has the image forming substance removed from its one side and is then fed to the second image removing unit 32.

The second image removing unit 32 is constructed as an inverted first image removing unit 31 and operates to remove the image forming substance from the other side of the recording medium 1.

In FIG. 1, the second image removing unit 32 has an image separating belt 322 functioning as an image separating material tensioned between conveying rollers **321*a* and 321*b*, a backup belt 324 functioning as a backup material touching the image separating belt 322 and tensioned between conveying rollers 323*a* and 323*b*, these belts 322 and 324 being driven by a drive means (not shown), a pressing roller 325 pressing on an inner side of the image separating belt 322, a heating roller 326 having a heating lamp therein pressing on an inner side of the backup belt 324 against the pressing roller 325, a separating claw 327 touching onto the image separating belt 322, and a cleaning roller 328 pressing against a surface of the image separating belt 322**.

Each part of the second image removing unit 32 works like each corresponding part of the first image removing unit 31 so that the recording medium 1 has the image forming substance removed from its the other side. The recording medium 1 fed from the first image removing unit 31 has the image forming substance on the other side removed by the second image removing unit 32, and then is fed to the finishing unit 4.

The second image removing unit 32 should be as close to the first image removing unit 31 as possible so that the image removal promoting liquid on the recording medium 1 is not evaporated travelling from the first image removing unit 31 to the second image removing unit 32. Further, these image removing units 31 and 32 should be constructed in a closed container 33 so that the image removal promoting liquid is hard to evaporate.

The finishing unit 4 is a unit for finishing and ejecting the recycled recording medium 1 out of the apparatus or for storing the recycled recording medium 1 in the finishing unit 4. The recording medium 1 with the image forming substance removed from its both sides is fed to finishing unit 4, is finished to dry thereon, and is ejected out of the apparatus or is stored in the finishing unit 4.

By utilizing such a device of the present invention as set forth in FIG. 1, the first image removing unit 31 and the second image removing unit 32 are offset from each other and remove images from opposite sides of the recording medium 1 by two serial processes. This provides the significant advantage that the image separating material of the image separating belt 312 of the first image removing unit 31 does not contact the image separating material of the image separating belt 322 of the second image removing unit 32. As a result, this embodiment provides the advantage that image separating belts 312 and 322 do not cling to each other after they have removed the image forming substances from the recording medium 1. The present invention also achieves such an operation without a complicated structure.

Using the apparatus as illustrated in FIG. 1, the Applicant performed tests in recycling a commercially available plain copy paper (Trademark "Type6200", made by Ricoh Company, Ltd.) having deposited images on its both sides using a commercially available copying machine (Trademark "IMAGIO320 FP1", made by Ricoh Company, Ltd.). In these tests, an image removal promoting liquid containing surface active agent (Trademark "MA80", made by Cytec Industrious.) of 5 wt. %, was applied to the image deposited surface of the paper with a coating amount of 3.0 g per a paper of A4 size using the apparatus as shown in FIG. 2(*a*). The image separating belts 312 and 322 were each an endless belt of polyethylene terephthalate having dispersed titanium oxide (made by Toray Industries, Inc.). The backup belts 314 and 324 were each an endless belt constructed of fluorine resins coated on a surface of polyimide. The surface temperature of the heating roller 316 was 100° C. The speed to feed the recording medium 1 was 10 mm/sec. As a result, the plain copy paper was recycled such that it was able to be used again. A subsequent image formed on the recycled paper by using the copying machine (Trademark "IMAGIO320 FP1", made by Ricoh Company, Ltd.) had about the same quality as on a non-recycled paper.

Figure 3:
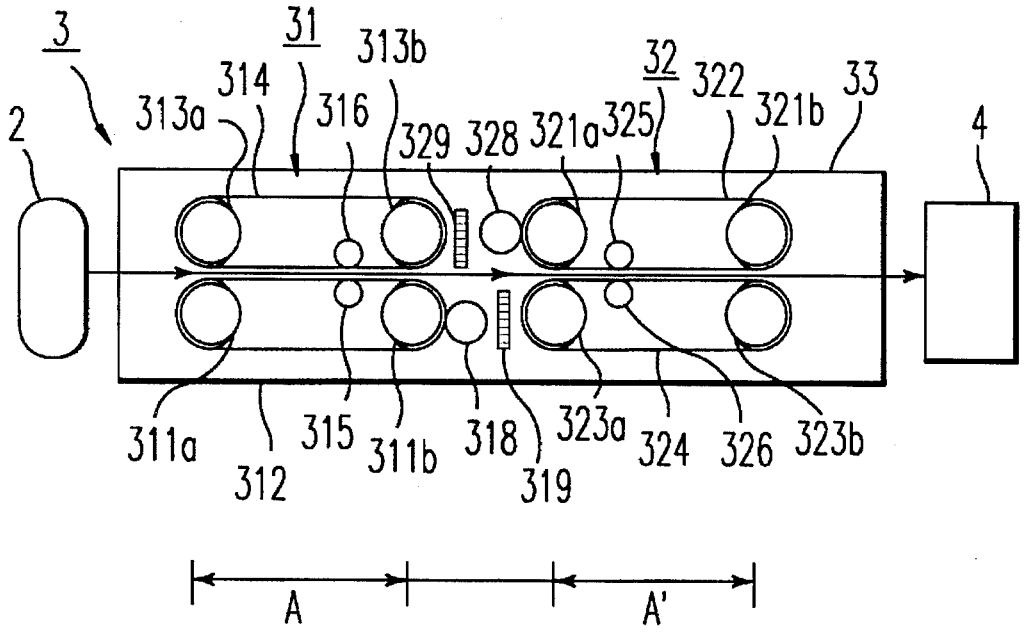
FIG. 3 shows another embodiment of the present invention having a pair of optical sensors for sensing an image forming substance remaining on a recording medium and means for feeding back a recording medium.

Referring now to FIG. 3, there is shown another embodiment of the present invention. This embodiment as shown in FIG. 3 is similar to the embodiment described above in FIG. 1 with the exception that this embodiment further includes a pair of optical sensors 319 and 329 for sensing an amount of the image forming substance on the recording medium 1, and this embodiment has an operation for feeding back the recording medium 1.

The liquid supplying unit 2, the first and second image removing units 31 and 32, and the finishing unit 4 shown in FIG. 3 are identical to the previously described embodiment of FIG. 1. Each part of this embodiment of FIG. 3 works like each corresponding part of the first embodiment so that the recording medium 1 has the image forming substance removed from its both sides. However, this embodiment of FIG. 3 has a further operation of being able to reverse the driving direction of the belts 312, 314 and 322, 324 to be able to feed back the recording medium 1 through the image removing units 31 and 32 again in a reciprocating motion.

The embodiment of FIG. 3 also further includes a pair of optical sensors, for example an upper sensor 319 and a lower sensor 329, for sensing an image forming substance on a surface of a recording medium 1, formed between the first and second image removing units 31 and 32, for sensing the image forming substance remaining on the surface of the recording medium 1 after the image forming substance removing operations.

These optical sensors 319, 329, for example, include a luminescence such as a luminescence diode and a light detecting element such as a photodiode so that the light detecting element senses a reflection light of the luminescence element from a search point on the surface of the recording medium, but the optical sensors 319, 329 are not limited to this constitution. In FIG. 3 there are two optical sensors 319, 329, but this embodiment is not limited to two optical sensors.

After removing the image forming substance from the first lower side of the recording medium 1 in the image removing unit 31, the lower surface of the recording medium 1 fed from the image removing unit 31 is sensed by the lower sensor 319, and is then fed to the second image removing unit 32. After removing the image forming substance from the second upper side of the recording medium 1 in the image removing unit 32, the recording medium 1 is fed back from the image removing unit 32 to the image removing unit 31 by reversing the direction of the belts 312, 314 and 322, 324, and the upper surface of the recording medium 1 is sensed by the upper sensor 329.

In a case that the image forming substance on either surface of the recording medium was not adequately removed, as sensed by sensors 319 and 329 sensing the upper and lower surfaces of the recording medium 1, the recording medium is fed through either or both of the first and second image removing units 31 and 32 again to more fully remove the image forming substance from the recording medium 1. In a case that the image forming substance on both surfaces of the recording medium is adequately removed as sensed by the sensors 319 and 329, the recording medium is fed to the finishing unit 4.

According to the embodiment as shown in FIG. 3, the recording medium 1 also has the image forming substance removed from its both sides perfectly without image separating materials clinging to each other and without complicating a structure of the apparatus.

Using the apparatus as illustrated in FIG. 3, the Applicant performed some tests in recycling a commercially available plain copy paper (Trademark "Type6200", made by Ricoh Company, Ltd.) having deposited images on its both sides using a commercially available copying machine (Trademark "IMAGIO320 FP1", made by Ricoh Company, Ltd.). In these tests, an image removal promoting liquid containing surface active agent (Trademark "MA80", made by Cytec Industries.) of 5 wt. %, was applied to the image deposited surface of the paper with a coating amount of 3.0 g per a paper of A4 size. The image separating belts 312 and 322 were each an endless belt of polyethylene terephthalate having dispersed titanium oxide (made by Toray Industries, Inc.). The backup belts 314 and 324 were each an endless belt constructed of fluorine resins coated on a surface of polyimide. The surface temperature of the heating roller 316 was 100° C. The speed to feed the recording 1 was 10 mm/sec. As a result, the plain copy paper was recycled such that it was able to be used again and it was free from images and had an excellent surface smoothness. A subsequent image formed on the recycled paper by using the copying machine (Trademark "IMAGIO320 FP1", made by Ricoh Company, Ltd.) had about the same quality as on a non-recycled paper.

Figure 4:
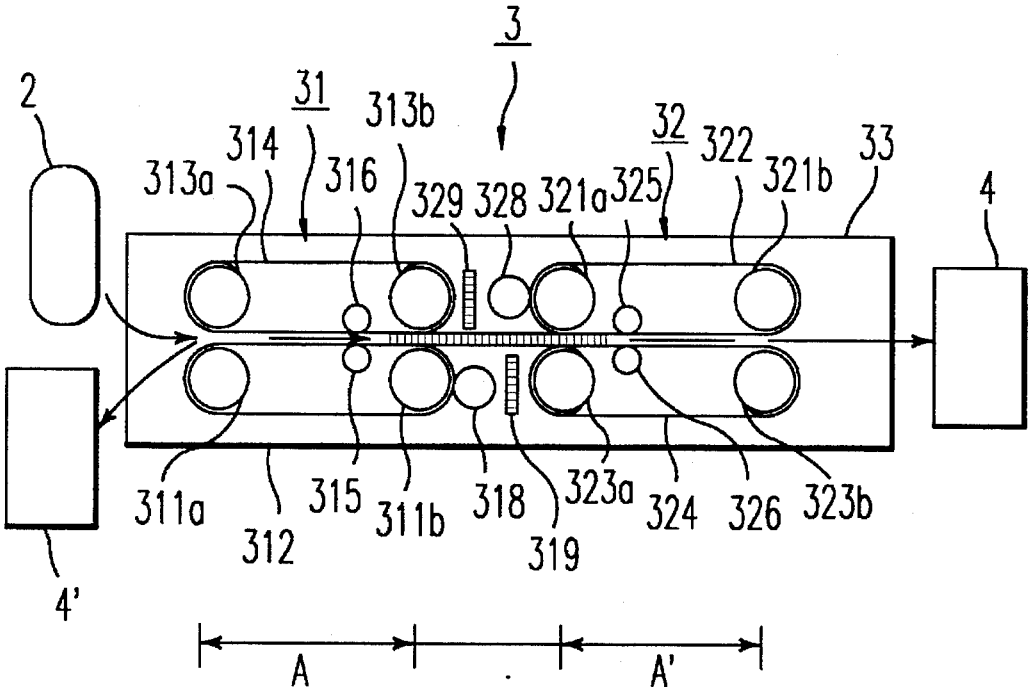
FIG. 4 shows a modification of the embodiment as shown FIG. 3 having another finishing unit.

Referring to FIG. 4, there is shown a modification of the second embodiment as shown FIG. 3. The apparatus shown in FIG. 4 is similar to that described above in FIG. 3 with the exception that this further embodiment includes another finishing unit 4' located on the same side as the liquid supplying unit 2. The finishing unit 4' is able to receive the recording medium 1 from the same side of the liquid supplying unit 2.

The liquid supplying unit 2, the first and second image removing unit 31 and 32, and the finishing unit 4 are identical to the previously described first and second embodiments, and like elements are given like reference characters. Each part of this further embodiment works like each corresponding part of the first and second embodiment so that the recording medium 1 has the image forming substance removed from its both sides. The belts 312, 314 and 322, 324 are constructed to be reversible in motion to be able to feed back the recording medium 1.

After removing the image forming substance from the first side of the recording medium 1 in the image removing unit 31, the recording medium 1 fed from the image removing unit 31 has its lower surface sensed by the lower sensor 319, and is then fed to the image removing unit 32. After removing the image forming substance from the second side of the recording medium 1 in the image removing unit 32, the recording medium 1 is fed back from the image removing unit 32 to the image removing unit 31, and has its upper surface sensed by the upper sensor 329.

In a case that the image forming substance on each surface of the recording medium is not adequately removed by the first and second image removing units 31 and 32 as sensed by the sensors 319 and 329, the recording medium 1 is fed through either or both of the image removing units 31 and 32 again to more fully remove the image forming substance forming substance from the recording medium 1. In a case that the image forming substance on each surface of the recording medium is adequately removed as sensed by the sensors 319 and 329, the recording medium is fed to the nearest finishing unit 4 or 4' having two finishing units 4 shortens the time for the total operation.

According to the embodiment as shown in FIG. 4, the recording medium has the image forming substance removed from its both sides perfectly and the overall operation is faster than in the embodiment as shown in FIG. 3, without image separating materials clinging to each other and without complicating a structure of the apparatus.

Figure 5:
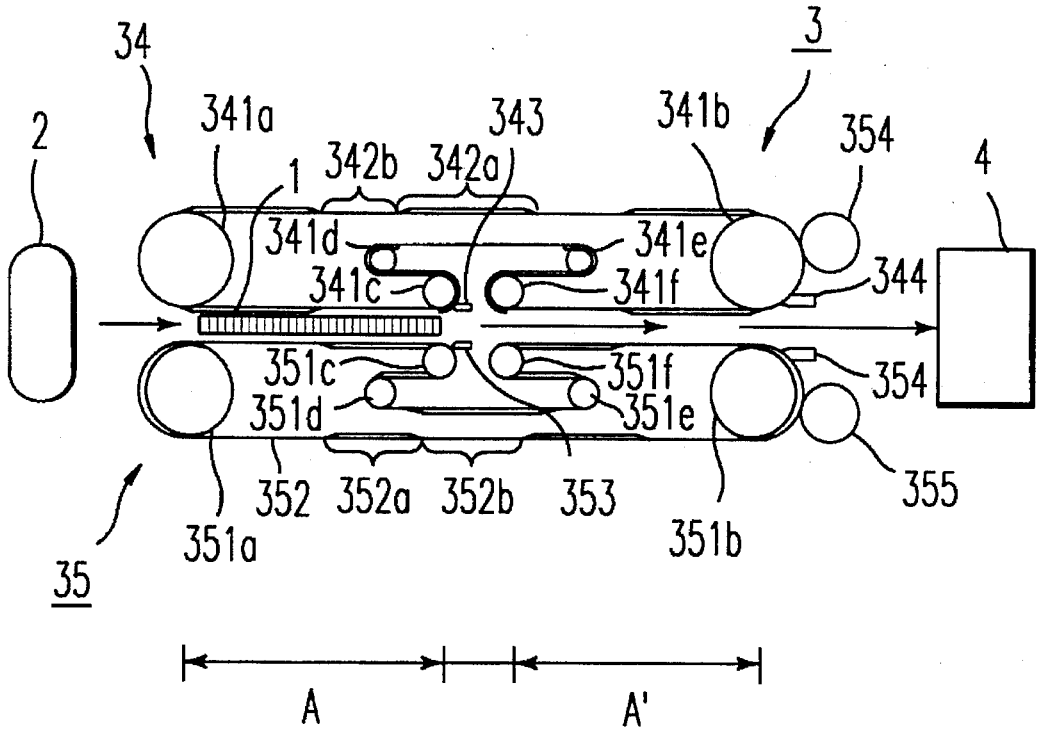
FIG. 5 shows yet another embodiment of the present invention having an upper image removing unit and a lower image removing unit.

Referring to FIG. 5, there is shown yet another embodiment of the present invention.

The apparatus of this embodiment as shown in FIG. 5 has a liquid supplying unit 2 and a finishing unit 4 which are similar to that as described in FIG. 1. This embodiment also includes an image removing unit 3 which includes an upper image removing unit 34 and a lower image removing unit 35.

The upper image-removing unit 34 includes an upper image-removing belt 342 featuring some portions of an image separating material 342*a* functioning as the image separating material and some portions of a non-image-separating material 342*b* functioning as a backup material, tensioned between conveying rollers 341*a*, 341*b*, 341*c*, 341*d*, 341*e*, 341*f*. A cleaning roller 345 presses against a surface of the upper image-removing belt 342, and two separating claws 343 and 344 are also provided.

The lower image-removing unit 35 includes a lower image-removing belt 352 featuring some portions of an image-separating material 352*a* functioning as the image separating material and some portions of a non-image-separating material 352*b* functioning as a backup material, tensioned between conveying rollers 351*a*, 351*b*, 351*c*, 351*d*, 351*e*, 351*f*. A cleaning roller 355 presses against a surface of the lower image-removing belt 352 and two separating claws 353 and 354 are also provided.

The image-removing belts 342, 352 come into contact with each other between conveying roller 341*a* and 341*c* (or between conveying rollers 351*a* and 351*c*) and between conveying rollers 341*f* and 341*b* (or between conveying roller 351*f* and 351*b*) although FIG. 5 shows these belts separated so the embodiment is more readily understandable. In this embodiment of FIG. 5, at this place in contact, an image-separating material 342*a* of belt 342 is set against a non-image-separating material 352*b* of belt 352. A length A between conveying rollers 341*a* and 341*c* is longer than a length of the recording medium in a feeding direction. A length A' between conveying rollers 341*f* and 341*b* is longer than a length of the recording medium in a feeding direction. The conveying roller 341*c* and the conveying roller 351*b* have heating lamps therein for heating the image forming substance on the recording medium 1.

The recording medium 1 impregnated with the image removal promoting liquid in the liquid supplying unit 2 has the image forming substance removed from both sides between roller 341*a* and roller 341*c* and between roller 341*f* and roller 341*b* in the image removing unit 3, and the recording medium 1 is then fed to the finishing unit 4.

According to the embodiment as shown in FIG. 5, the recording medium has an image forming substance removed from its both sides without image separating materials clinging to each other and without complicating a structure of the apparatus. This results because in this embodiment the image-separating portions 342*a* of the upper belt 342 only directly oppose (i.e., contact) non-image-separating portions 352*b* of the lower belt 352, and vice versa.

Using the apparatus as illustrated in FIG. 5, the Applicant performed some tests in recycling a commercially available plain copy paper (Trademark "Type6200", made by Ricoh Company, Ltd.) having deposited images on its both sides using a commercially available copying machine (Trademark "IMAGIO320 FP1", made by Ricoh Company, Ltd.). In these tests, an image removal promoting liquid containing surface active agent (Trademark "MA80", made by Cytec Industries.) of 5 wt. %, was applied to the image deposited surface of the paper with a coating amount of 3.0 g per a paper of A4 size using the apparatus as shown in FIG. 2(*a*). The upper image-removing belt 342 and the lower image-removing belt 352 included portions of coated fluorine resins at intervals of 105 mm on an endless belt of polyethylene terephthalate having dispersed titanium oxide (made by Toray Industries, Inc.) with a length of 1260 mm, and with a thickness of 100 μm. The surface temperature of the heating roller 316 was 100° C. The speed to feed the recording medium 1 was 10 mm/sec. As a result, a plain copy paper was recycled such that it was able to be used again. A subsequent image formed on the recycled paper by using the copying machine (Trademark "IMAGIO320 FP1", made by Ricoh Company, Ltd.) had about the same quality as on a non-recycled paper.

Figure 6:
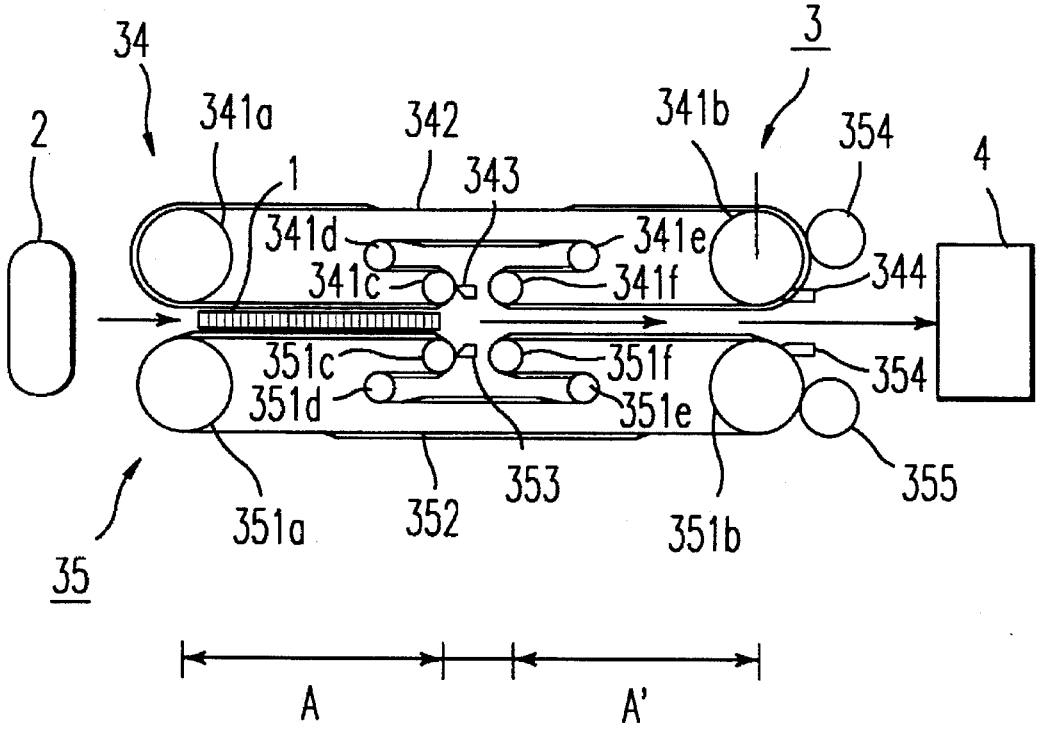
FIG. 6 shows a modification of the embodiment as shown FIG. 5 in which a length of each part of an image separating material and each part of a non-image-separating material is longer than a length of a recording medium in a feeding direction.

Referring to FIG. 6, there is shown a modification of the embodiment as shown FIG. 5. The apparatus shown in FIG. 6 is similar to that as described in FIG. 5 with the exception that a length of each part of the image separating material 342*a*, 352*a* is longer than a length of the recording medium 1 in a feeding direction, and a length of each part of the non-image-separating material 342*b*, 352*b* is longer than a length of the recording medium 1 in the feeding direction. Each unit as shown FIG. 6 is identical to the corresponding units of the previously described embodiment of FIG. 5, and like elements are given like reference characters. Each part of this embodiment of FIG. 6 works like each corresponding part of the embodiment as shown FIG. 5 so that the recording medium 1 has the image forming substance removed from its both sides.

The recording medium 1 impregnated with the image removal promoting liquid in the liquid supplying unit 2 has the image forming substance removed from its both sides between roller 341*a* and roller 341*c* and between roller 341*f* and roller 341*b* in the image removing unit 3, and the recording medium 1 is then fed to the finishing unit 4.

According to the embodiment as shown in FIG. 6, the recording medium has the image forming substance removed from its both sides without an image forming substance lingering on the surface of the recording medium corresponding to the boundary of each material of the belts.

Using the apparatus as illustrated in FIG. 6, the Applicant performed some tests in recycling a commercially available plain copy paper (Trademark "Type6200", made by Ricoh Company, Ltd.) having deposited images on its both sides using a commercially available copying machine (Trademark "IMAGIO320 FP1", made by Ricoh Company, Ltd.). In these tests, an image removal promoting liquid containing surface active agent (Trademark "MA80", made by Cytec Industries.) of 5 wt. %, was applied to the image deposited surface of the paper with a coating amount of 3.0 g per a paper of A4 size using the apparatus as shown in FIG. 2(*a*). The upper image-removing belt 342 and the lower image-removing belt 352 included portions of coated fluorine resins at intervals of 220 mm on an endless belt of polyethylene terephthalate having dispersed titanium oxide (made by Toray Industries, Inc.) with a length of 1220 mm, and with a thickness of 100 μm. As a result, all of a hundred plain copy papers were recycled without any image forming substance lingering on the papers, although in a case of using the apparatus as shown in FIG. 5 in equal conditions, nine sheets of the hundred of the papers had an image forming substance lingering thereon in a form of a line.

Figure 7:
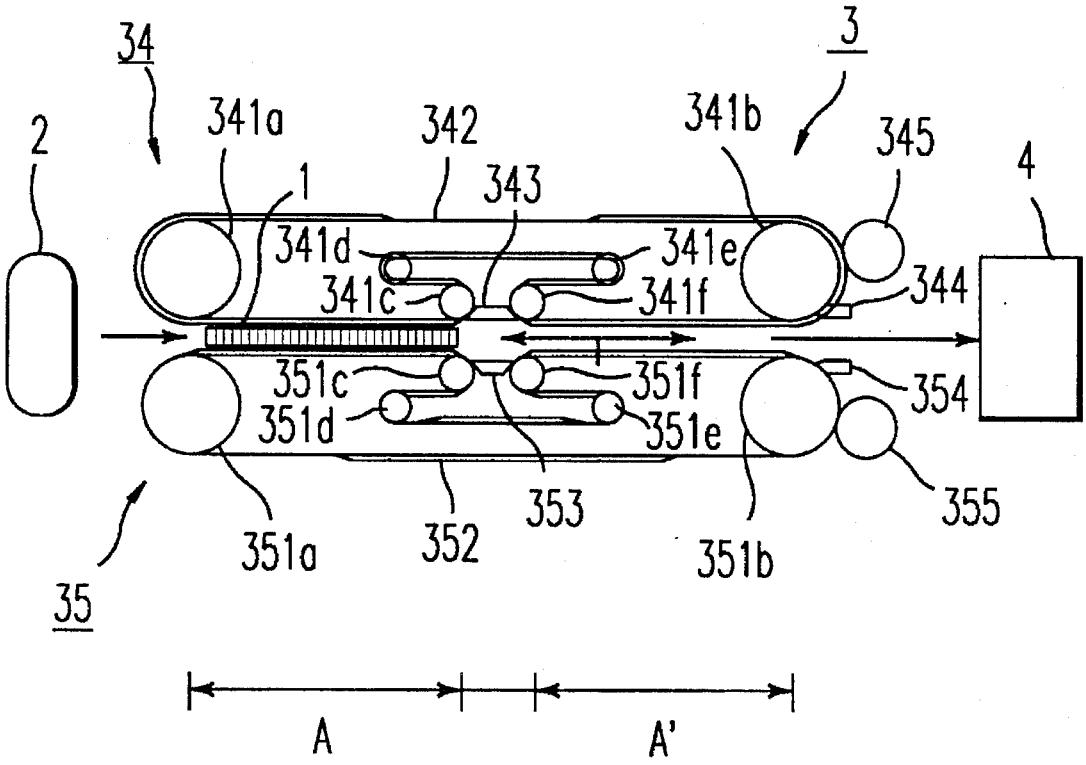
FIG. 7 shows a modification of the embodiment as shown in FIG. 5 having means for feeding back a recording medium.

Referring to FIG. 7, there is shown a modification of the embodiment as shown in FIG. 5 and FIG. 6. The apparatus shown in FIG. 7 is similar to that described in FIG. 5 with the exception that the belts 342, 352 are constructed to be able to be reversible in driving direction to feed back the recording medium 1, and the conveying roller 351*f* instead of the conveying roller 351*b* has a heating lamp therein for heating the image forming substance on the recording medium 1.

That is, in this embodiment as shown in FIG. 7, the driving direction of the belts 342, 352 can be reversed to feed back the recording medium 1 in a reciprocating motion. In this way, the image recording medium 1 can undergo the image forming substance removal operations a number of times until the image forming substances are adequately removed from the recording medium 1.

Each other unit as shown FIG. 7 is identical to the previously described embodiments, and like elements are given like reference characters. Each part of this embodiment of FIG. 7 works like each corresponding part of the embodiment as shown FIG. 5 so that the recording medium 1 has the image forming substance removed from its both sides.

The recording medium 1 impregnated with the image removal promoting liquid in the liquid supplying unit 2 has the image forming substance removed from its both sides between roller 341*a* and roller 341*c* and between roller 341*f* and roller 341*b* in the image removing unit 3, and the recording medium 1 is then fed to the finishing unit 4.

According to the embodiment as shown in FIG. 7, the recording medium 1 has the image forming substance removed from its both sides perfectly without image separating materials clinging to each other and without complicating a structure of the apparatus.

Using the apparatus as illustrated in FIG. 7, the Applicant performed some tests in recycling a commercially available plain copy paper (Trademark "Type6200", made by Ricoh Company, Ltd.) having deposited images on its both sides using a commercially available copying machine (Trademark "IMAGIO320 FP1", made by Ricoh Company, Ltd.). In these tests, an image removal promoting liquid containing surface active agent (Trademark "MA80", made by Cytec Industries) of 5 wt. %, was applied to the image deposited surface of the paper with a coating amount of 3.0 g per a paper of A4 size using the apparatus as shown in FIG. 2(*a*), the upper image-removing belt 342 and the lower image-removing belt 352 include portions of coated fluorine resins at intervals of 220 mm on an endless belt of polyethylene terephthalate having dispersed titanium oxide (made by Toray Industries, Inc.) with a length of 1320 mm, and a thickness of 100 μm. As a result, the plain copy paper was recycled such that it was able to be used again and to be free from images and had an excellent surface smoothness. A subsequent image formed on the regenerated paper by using the copying machine (Trademark "IMAGIO320 FP1", made by Ricoh Company, Ltd.) had about a same quality as on a non-recycled paper.

Figure 8:
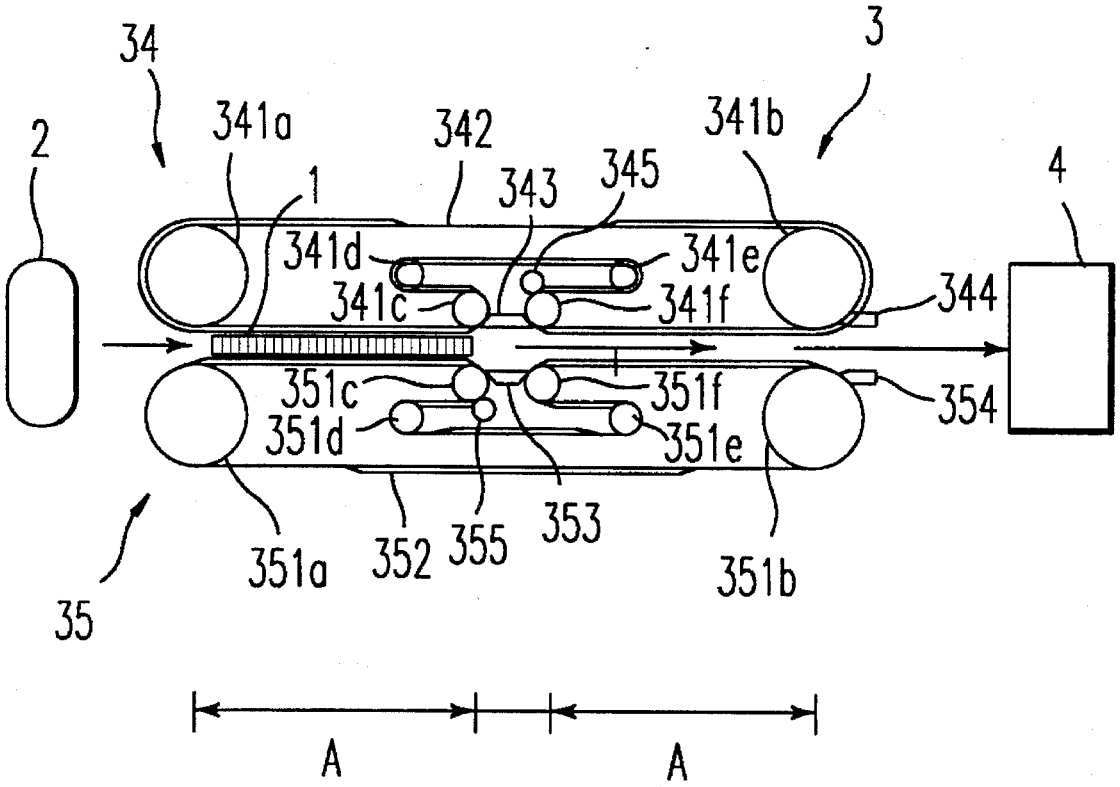
FIG. 8 shows a modification of the embodiment of FIG. 7.

FIG. 8 shows a further embodiment of the present invention. The embodiment of FIG. 8 is similar to the embodiment of FIG. 7 except that the embodiment shown in FIG. 8 moves the positioning of the cleaning rollers 345 and 355. More specifically, in the embodiment shown in FIG. 8 the cleaning roller 345 is placed adjacent to roller 341*f* and the cleaning roller 355 is placed adjacent to roller 351*c*. This embodiment shown in FIG. 8 provides a further advantage of minimizing a distance that the image separating material must travel before the toner which the image separating material picks up is removed by the cleaning rollers 345 and 355.

In the embodiment shown in FIG. 8 of the present specification, as an example, after the image separating portion of the belt 342 removes toner from the recording medium 1, the image separating portion of the belt 342 only has to travel a small distance before it contacts cleaning roller 345, and subsequently has the toner which it has removed from the recording medium 1 removed therefrom. This provides the advantage in the embodiment of FIG. 8 of allowing minimum time for the toner to settle into the image separating portion of the belt 342. That is, the quicker that the toner is removed from the image separating material of the belt 342, the easier it is to remove such toner as the toner has less time to settle into the image separating material of the belt 342. With the embodiment of FIG. 8, the cleaning rollers 345 and 355 are positioned so that the image separating material of the respective belts 342, 352 only have to travel a small distance before the toner is removed therefrom. Thus, this embodiment of FIG. 8 makes the removal of toner from the image separating material of the belts 342, 352 easier.

Obviously, numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. An apparatus for recycling a recording medium having an image forming substance deposited on both sides of the recording medium, comprising:

a first image removing unit for removing the image forming substance from a first side of the recording medium;

a second image removing unit for removing the image forming substance from a second side of the recording medium;

a driving portion for feeding the recording medium through the first image removing unit and through the second image removing unit;

wherein each image removing unit comprises:

an image separating material constructed of a substance for making the image forming substance tend to adhere thereto; and a backpressing material opposite to said image separating material for pressing the recording medium between the image forming substance and a surface of the backpressing material, the backpressing material being formed of a material to which the image forming surface tends not to adhere.

2. The apparatus for recycling a recording medium according to claim 1, wherein in each image removing unit:

the image separating material is formed as an image separating belt functioning for making the image separating material tend to adhere thereto, the image separating belt being tensioned between first conveying rollers; and the back pressing material is formed as a backup belt functioning as the backup material touching the image separating belt, the backup belt being tensioned between second conveying rollers.

3. The apparatus for recycling a recording medium according to claim 2, wherein the driving portion to feeds back the recording medium through the first and second image removing units in a reciprocating motion.

4. The apparatus for recycling a recording medium according to claim 3, further comprising at least one sensor positioned next to at least one of the first and second image removing units for sensing a quantity of the image forming substance remaining on a surface of the recording medium.

5. The apparatus for recycling a recording medium according to claim 1, wherein the driving portion to feeds back the recording medium through the first and second image removing units in a reciprocating motion.

6. The apparatus for recycling a recording medium according to claim 5, further comprising at least one sensor positioned next to at least one of the first and second image removing units for sensing a quantity of the image forming substance remaining on a surface of the recording medium.

7. The apparatus for recycling a recording medium according to claim 1, further comprising means for feeding the recording medium out of a first side and second side of the apparatus.

8. The apparatus for recycling a recording medium according to claim 1, wherein each image removing unit is constructed by an upper image removing belt and a lower image removing belt, wherein a portion of the image separating material is formed in first portions of the upper image removing belt functioning as the image separating material and a portion of the backpressing material is formed in second portions of the upper image removing belt functioning as a backup material, tensioned between first conveying rollers, and wherein a portion of the image separating material is formed in first portions of the lower image-removing belt functioning as the image separating material and a portion of the backpressing material is formed in second portions of the lower image removing belt functioning as a backup material, tensioned between second conveying rollers.

9. The apparatus for recycling a recording medium according to claim 8, wherein a length of each portion of the image separating material and the backpressing material is longer than a length of a recording medium in a feeding direction.

10. The apparatus for recycling a recording medium according to claim 9, wherein the driving portion to feeds back the recording medium through the first and second image removing units in a reciprocating motion.

11. The apparatus for recycling a recording medium according to claim 10, further comprising at least one sensor positioned next to at least one of the first and second image removing units for sensing an image forming substance remaining a surface of the recording medium.

12. The apparatus for recycling a recording medium according to claim 8, wherein the driving portion to feeds back the recording medium through the first and second image removing units in a reciprocating motion.

13. The apparatus for recycling a recording medium according to claim 12, further comprising at least one sensor positioned next to at least one of the first and second image removing units for sensing an image forming substance remaining a surface of the recording medium.

14. The apparatus for recycling a recording medium according to claim 8, further comprising means for feeding the recording medium out of a first side and a second side of the apparatus.

* * * * *